US005332489A

United States Patent [19]

Veluswamy

[11] Patent Number: 5,332,489

[45] Date of Patent: Jul. 26, 1994

[54] HYDROCONVERSION PROCESS FOR A CARBONACEOUS MATERIAL

[75] Inventor: Lavanga R. Veluswamy, Baton Rouge, La.

[73] Assignee: Exxon Research & Engineering Co., Florham Park, N.J.

[21] Appl. No.: 75,711

[22] Filed: Jun. 11, 1993

[51] Int. Cl.[5] ..... C10G 45/08; C10G 1/00; C10G 1/06

[52] U.S. Cl. ..... 208/56; 208/49; 208/415; 208/418

[58] Field of Search ..... 208/10, 111, 56, 87, 208/56, 8 LE, 89, 58, 50, 80, 415, 418, 49; 252/431 C

[56] References Cited

U.S. PATENT DOCUMENTS

| | | | |
|---|---|---|---|
| 3,645,885 | 2/1972 | Harris | 208/8 |
| 4,077,867 | 3/1978 | Aldridge et al. | 208/10 |
| 4,115,246 | 9/1978 | Sweany | 208/56 |
| 4,226,742 | 10/1980 | Bearden, Jr. et al. | 252/431 C |
| 4,295,995 | 10/1981 | Bearden et al. | 252/431 |
| 4,330,392 | 5/1982 | Bearden et al. | 208/10 |
| 4,411,767 | 10/1983 | Garg | 208/10 |
| 4,417,972 | 11/1983 | Francis et al. | 208/10 |
| 4,465,587 | 8/1984 | Garg et al. | 208/87 |
| 4,485,008 | 11/1984 | Maa et al. | 208/10 |
| 4,541,914 | 9/1985 | Hirokoh et al. | 208/10 |
| 4,545,890 | 10/1985 | Schindler et al. | 208/8 LE |
| 4,659,454 | 4/1988 | Varyhese et al. | 208/111 |
| 5,108,581 | 4/1992 | Aldridge et al. | 208/108 |

OTHER PUBLICATIONS

Energeia, CAER-University of Kentucky, Center for Applied Research; vol. 2, No. 2, 1991; pp. 1-8.

*Primary Examiner*—Helen M. S. Sneed
*Assistant Examiner*—Bekir L. Yildirim
*Attorney, Agent, or Firm*—Richard D. Jordan

[57] ABSTRACT

This invention relates to a process for converting a carbonaceous material to a liquid product using a hydrogen donor solvent. More specifically, this invention relates to a process for hydroconverting carbonaceous material in which a 400°-1000° F. hydroconversion product fraction is further hydrocracked and a hydrocracked fraction is used as the hydrogen donor solvent. An increased quantity of liquid product is achieved by removing an ash residuum from the hydroconversion product fraction prior to the hydrocracking process.

9 Claims, 1 Drawing Sheet

HYDROCONVERSION PROCESS FOR A CARBONACEOUS MATERIAL

FIELD OF THE INVENTION

This invention relates to a process for converting a carbonaceous material to a liquid product using a hydrogen donor solvent. More specifically, this invention relates to a process for hydroconverting carbonaceous material in which a 400° F. hydroconversion product fraction is further hydrocracked and a 400°-1000° F. hydrocracked fraction is used as the hydrogen donor solvent. An increased quantity of liquid product is achieved by removing an ash residuum from the hydroconversion product fraction prior to the hydrocracking process.

BACKGROUND OF THE INVENTION

Hydroconversion of carbonaceous material using a hydrogen donor solvent is well known. The known processes include both catalytic and non-catalytic reactions. In non-catalytic processes, the hydrogen donor solvent is reacted in the presence of molecular hydrogen at elevated temperature and pressure. See, for example, U.S. Pat. No. 3,645,885, the teachings of which are incorporated herein by reference. In catalytic processes, the hydrocarbonaceous material is slurried with a solvent and a catalyst, and is reacted in the presence of molecular hydrogen at elevated temperatures and pressures. See, for example, U.S. Pat. No. 4,485,008, the teachings of which are incorporated herein by reference.

Generally, both the known catalytic and non-catalytic processes produce relatively high gas yields and aromatic distillates with high heteroatom content. These types of distillate compounds generally have sulfur, nitrogen, or oxygen in the ring structure. Extensive downstream upgrading may be required in order to convert the aromatic distillates to gasoline or fuel oils and removing heteroatoms from the products. Upgrading is expensive, however, Therefore, it is economically desirable to employ a catalytic hydroconversion procedure which reduces gas production as well as the heteroatom content of the raw liquid product.

Combining the hydrocracking process with a hydroconversion process is also known. It has also been suggested to filter a hydroconversion product before performing the hydrocracking reaction. See, for example, *Energia,* vol. 2, No. 2, 1991, pages 1 and 2. However, the known processes leave much room for improving gas and liquid production, particularly improving light product production without rapid catalyst deactivation as well as for improving heteroatom removal.

SUMMARY OF THE INVENTION

It is an object of this invention to overcome many of the problems inherent in the prior art. In order to overcome these problems, the invention provides for a process for hydroconverting a carbonaceous material which comprises forming a mixture of carbonaceous material and hydrogen donor solvent; reacting the mixture in the presence of a hydrogen gas, under hydroconversion conditions, to form a hydroconversion product stream; separating a liquid fraction of the hydroconversion product stream, wherein the liquid fraction has an initial boiling point of about 350° F., into a clarified fraction and an ash residuum; and hydrocracking the clarified fraction in the presence of hydrogen and a metal catalyst activated from an oil soluble metal, under hydrocracking conditions, wherein the metal has a concentration of about 2-20 wt % on the basis of the clarified fraction being hydrocracked, and is selected from the group consisting of Groups II, III, IV, V, VIB, VIIB and VIII of the Periodic Table of Elements, to form a hydrocracked product stream.

BRIEF DESCRIPTION OF THE DRAWINGS

The present invention will be better understood by reference to the Description of the Preferred Embodiments when taken together with the attached drawing, wherein.

DETAILED DESCRIPTION OF INVENTION

Figure 1:
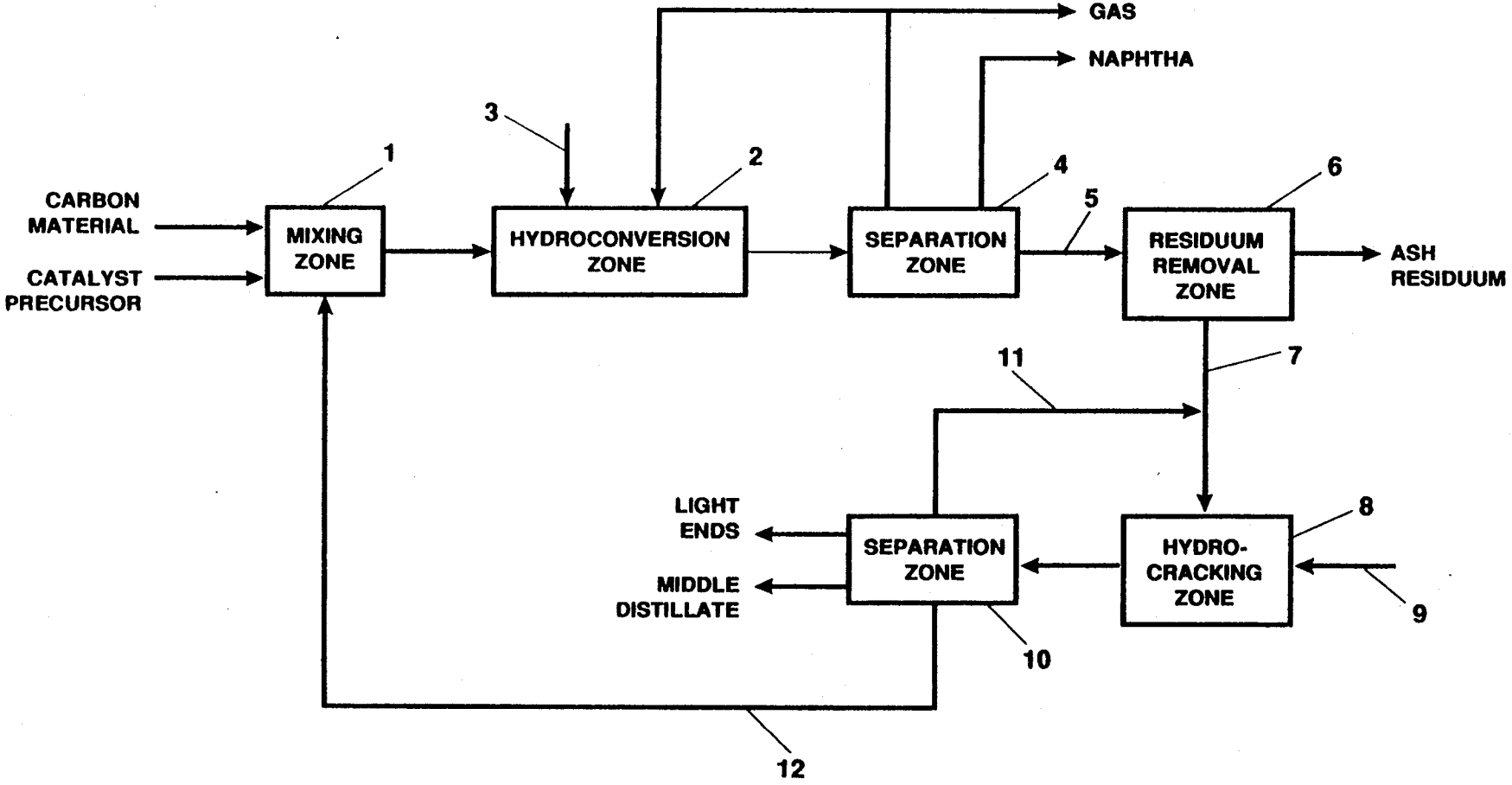
FIG. 1 is a schematic flow plan of a preferred embodiment of this invention.

The process of the invention is generally applicable to the hydroconversion of heteroatom containing carbonaceous feeds such as heavy hydrocarbonaceous oils having constituents boiling above about 900° F., coal and mixtures thereof. Suitable heavy hydrocarbonaceous oil feeds include heavy mineral oils; crude petroleum oils, including heavy mineral oils; residual oils such as atmospheric residuum and vacuum residuum; tar; bitumen; tar sand oils; shale oils; liquid products derived from coal liquefaction processes, including coal liquefaction bottoms, and mixtures thereof. The process is also applicable for the simultaneous conversion of mixtures of coal and a hydrocarbonaceous oil.

The term "coal" as used herein refers to a normally solid carbonaceous material such as anthracite, bituminous coal, sub-bituminous coal, lignite and mixtures thereof. All boiling points referred to herein are atmospheric pressure boiling points unless otherwise specified.

In the hydroconversion of coal, the coal is preferably mixed with a hydrogen donor solvent. The hydrogen donor solvent employed is preferably an intermediate stream which boils between about 350° F. and 1000° F., preferably between about 400° F. and about 900° F. This stream comprises hydrogenated aromatics, naphthenic hydrocarbons, phenolic materials and similar compositions. These compositions preferably include at least about 20 wt % preferably at least about 50 wt % compounds which function as hydrogen donors under typical hydroconversion conditions. Such hydroconversion conditions are well known in the art. Compounds which are acceptable as hydrogen donor solvents include hydrogenated creosote oil, hydrogenated intermediate product streams from catalytic cracking of petroleum feedstocks, and other coal-derived liquids which are rich in indane, $C_{10}$-$C_{12}$ tetralins, decalins, biphenyls, methylnaphthalene, dimethylnaphthalene, $C_{12}$-$C_{13}$ acenaphthenes and tetrahydroacenaphthene and similar donor compounds.

When the process is used to hydroconvert coal, the coal is preferably provided in particulate form. The coal particles preferably are of a size which range up to about one eighth inch in diameter suitably 8 mesh (Tyler). The coal particles and hydrogen donor solvent are preferably mixed at a solvent-to-coal weight ratio in the range of about 1-5 to 1, more preferably about 1.5-2 to 1.

The hydroconversion reaction of this invention can be a catalytic or non-catalytic reaction. In the non-catalytic reaction, a slurry of carbonaceous material in a hydrogen donor solvent is reacted in the presence of a hydrogen gas at elevated temperature and pressure. Prior to the reaction process, the carbonaceous material is mixed with the hydrogen donor solvent. Preferably, a slurry is formed which has a temperature of about 300°–400° F., and a solvent to coal weight ratio of about 0.8:1 to 2:1. After the slurry is formed, it is preferably heated to a temperature of about 700°–900° F., and a hydrogen gas is introduced. It is preferable to include a sufficient quantity of hydrogen gas which forms a slurry having about 0.1 to 15 wt % hydrogen which will be used in the hydroconversion reaction. Preferably, the hydrogen gas will be supplied such that the hydroconversion reaction zone will have a hydrogen partial pressure of about 500–5000 psig.

In the catalytic hydroconversion reaction of this invention, the catalyst is preferably converted to an active catalyst from an oil-soluble metal compound or dispersible metal compound. The metal compound may be a compound that is soluble in a hydrocarbonaceous oil or a compound that is soluble in a liquid organic medium that can be dispersed in the hydrocarbonaceous oil. The metal compound may also be a compound that is water soluble, and an aqueous solution of the compound can be dispersed in the hydrocarbonaceous medium. The metal compound may also be an inexpensive disposable heterogeneous catalyst.

Preferably, when a catalyst is used in the hydroconversion reaction of this invention, it is an active metal catalyst that has been converted from a metal-containing, oil-dispersible compound under process conditions. Suitable oil-soluble compounds which are convertible to active metal catalysts under process conditions include (1) metal-containing inorganic compounds such as metal-containing halides, oxyhalides, hydrated oxides, heteropoly acids (e.g., phosphomolybdic acid, molybdosilisic acid); (2) metal salts of organic acids such as acyclic and alicyclic aliphatic carboxylic acids containing two or more carbon atoms (e.g., naphthenic acids); aromatic carboxylic acids (e.g., toluic acid); sulfonic acids (e.g., toluenesulfonic acid); sulfinic aids; mercaptans, xanthic acid; phenols, di and polyhydroxy aromatic compounds; (3) metal-containing organometallic compounds including metal-containing chelates such as 1,3-diketones, ethylene diamine, ethylene diamine tetraacetic acid, phthalocyanines, etc.; and (4) metal salts of organic amines such as aliphatic amines, aromatic amines, and quaternary ammonium compounds.

The metal constituent of the oil soluble or oil dispersible metal compound that is convertible to a solid, metal-containing catalyst is selected from the group consisting of Groups II, III, IV, V, VIB, VIIB and VIII, and mixtures thereof of the Periodic Table of the Elements. Non-limiting examples include zinc, antimony, bismuth, titanium, cerium, vanadium, niobium, tantalum, chromium, molybdenum, tungsten, manganese, rhenium, iron, cobalt, nickel and the nobel metals including platinum, iridium, palladium, osmium, ruthenium, and rhodium. The preferred metal constituent of the oil dispersible compound is selected from the group consisting of molybdenum, tungsten, vanadium, chromium, cobalt, titanium, iron, nickel and mixtures thereof. Preferred compounds of the given metals include the salts of acyclic (straight or branch chained) aliphatic carboxylic acids, salts of cyclic aliphatic carboxylic acids, polyacids, carbonyls, phenolares and organoamine salts.

The Periodic Table of the Elements referred to herein is published by Sargent-Welch Scientific Company, copyright 1979, available as catalog no. S-18806. Oil dispersible metal compounds which can be used in this invention are also described in U.S. Pat. No. 4,295,995, the teachings of which are incorporated herein by reference. The preferred oil dispersible metal compounds are inorganic polyacids of metals selected from Groups VA, VIA, and mixtures thereof. Included in this group are vanadium, niobium, chromium, molybdenum, tungsten and mixtures thereof. Suitable inorganic polyacids include phosphomolybdic acid, phosphotungstic acid, phosphovanadic acid, silicomolybdic acid, silicotungstic acid, silicovanadic acid and mixtures thereof. The preferred polyacid is a phosphomolybdic acid. The terms "heteropolyacids" and "isopolyacids" are used in accordance with the definitions given in *Advanced Inorganic Chemistry,* 4th Edition, S. A. Cotton and Geoffrey Wilkinson, Interscience Publishers, N.Y., pages 852–861.

Another preferred oil soluble metal compound is a salt of an alicyclic aliphatic carboxylic acid such as a metal naphthenate. Other preferred types of oil soluble metal compounds are metal containing heteropoly acids, e.g., phosphomolybdic acid, as well as oil soluble and/or highly dispersible molybdenum complexes such as:

$$MoO_2(S_2C\overset{\overset{R_1}{|}}{N}R_2)_2$$

where $R_1$ and $R_2$ can be the same or different and each can be a $C_1$ to $C_{18}$ alkyl group, a $C_5$ to $C_8$ cycloalkyl group, a $C_6$ to $C_{18}$ alkyl substituted cycloalkyl group, or a $C_6$ to $C_{18}$ aromatic or alkyl substituted aromatic group, $$Mo_2O_2(\mu\text{-}S)_2(S_2C\overset{\overset{R_1}{|}}{N}R_2)_2$$

where $R_1$ and $R_2$ are as indicated above, and $\mu$-S denotes a sulfide ($S^{2-}$) ligand bridging the two molybdenum atoms, or any related complex of molybdenum with dithiocarbamate, dithiophosphate, xanthates, or thioxanthate ligands.

In another preferred embodiment of the present invention, the molybdenum complex is dioxobis(n-dibutyldithiocarbamato)$MoO_2$, generally referred to as dioxoMoDTC.

In still other preferred embodiments of the invention, the molybdenum complex is $$Mo_2O_2(\mu\text{-}S)_2(S_2C\overset{\overset{R_1}{|}}{N}R_2)_2,$$ where R1 and R2 are n-butyl.

Other metal compositions which are useful in this invention include the compounds $(C_2H_5OCH_2CH_2OCS_2)_2Ni$ and $(C_2H_5OCH_2CH_2OCS_2)_2Pt$. These compounds are generally referred to as NiEEX and PtEEX, respectively.

Although Mo may be used alone as the metal component of the catalyst in the hydroconversion process, it is often promoted with certain metals in upgrading operations such as hydrotreating and hydrocracking. Such metals include Ni, Co, Cu, Pt, Pd and Sn. These metals have been found to have a promoting effect on Mo, increasing liquid yields and cracking selectivity at high catalyst concentrations as well as reducing the presence of heteroatoms such as S and N.

In another preferred embodiment of the instant invention, the catalyst preferably comprises Mo or Mo promoted with Ni, Co, Cu, Pt, Pd or Sn. Preferably, the catalyst metal will comprise Mo and Ni at a mole ratio of between about 2:1 and 4:1, more preferably about 3:1. The total concentration of metal on the basis of carbonaceous material will be less than about 10 wt %.

When an oil-soluble metal compound or dispersible metal compound is used in this invention, it is preferably dissolved in a hydrogen donor solvent and slurried with the carbonaceous material, preferably coal. At this stage, the metal compound is actually considered a catalyst precursor and should be activated to proceed with the hydroconversion process, which typically takes place in a hydroconversion zone. The catalyst precursor is preferably mixed with the solvent at a solvent to catalyst precursor ratio of about 1-2 to 1, more preferably about 1.6 to 1.

Various methods can be used to convert the catalyst precursor to an active catalyst. A preferred method of activating the catalyst precursor is to heat the mixture of catalyst precursor, carbonaceous material and solvent to a temperature ranging from about 600° F. to 1000° F., at a pressure ranging from about 500 psig to 5000 psig, in the presence of a hydrogen-containing gas. The hydrogen-containing gas can be molecular hydrogen or a hydrogen donating gas such as hydrogen sulfide. The activation process can be performed prior to entering the hydroconversion zone, or the hydroconversion zone can be used for both activating the catalyst and hydroconverting the carbonaceous feed material to form the hydroconversion products.

In typical hydroconversion processes, a liquid fraction of the hydroconversion product is used as the hydrogen donor solvent. Hydroconversion product quality is improved in the process of this invention, however, by improving the quality of hydrogen donor solvent. The quality of the hydrogen donor solvent is improved by separating out ash residuum which can significantly accumulate and inhibit the hydroconversion reaction. In addition, the quality of the hydrogen donor solvent is improved by hydrocracking a wide cut hydroconversion distillate fraction and using a wide cut fraction of the hydrocracked product as the hydrogen donor solvent.

In the present invention, the products of the hydroconversion reaction are separated into a gas fraction, low boiling point liquid, and a middle to heavy boiling point fraction which includes solid non-distillate materials. The middle to heavy boiling point fraction is recovered and separated into a clarified fraction and an ash residuum. The ash residuum comprises mineral matter including, for example, silica, alumina, iron sulfide and iron sulfate, and unreacted carbonaceous material. The term "clarified" does not necessarily mean that the clarified fraction is "clear", but that a significant portion of ash residuum has been separated from the middle to heavy boiling point fraction. It is preferable that at least about 50 wt % of the ash residuum be removed from the middle to heavy boiling point fraction to form the clarified fraction. The ash residuum can be separated by any of several well known means including by centrifugation, filtration, hydroclone separation, liquid extraction and distillation.

After the ash residuum separation step, the clarified fraction is catalytically hydrocracked. The catalyst used in the hydrocracking step is prepared from an oil soluble metal compound or oil dispersible metal compound as described above, wherein the metals content on the basis of carbonaceous material being hydrocracked is preferably about 2-20 wt %. The hydrocracking step results in a hydrocracked product stream which is increased in light and middle distillate fraction and has a middle to heavy distillate fraction which can be used as the hydrogen donor solvent in the hydroconversion zone. Because the clarified fraction is used in the hydrocracking reaction, the overall product will have an increased liquid product yield and a lower heteroatom concentration relative to typical hydroconversion processes.

One embodiment of the present invention is shown in FIG. 1 in which a catalytic hydroconversion reaction is used. In this preferred embodiment, a carbonaceous material such as particulate coal is added to a mixing zone 1 along with a catalyst precursor. Although the preferred embodiment depicts a catalytic hydroconversion reaction, a non-catalytic hydroconversion reaction can be effectively employed. The non-catalytic process works in a similar manner to what is shown in FIG. 1, except that a catalyst precursor, or any other type of catalyst component, is not used. The non-catalytic process would also preclude the use of recycle lines for recovering catalyst from any bottoms streams which are recovered in the overall process.

In the preferred embodiment of FIG. 1, the catalyst precursor and carbonaceous material, which are added to the mixing zone 1, are further slurried with a hydrogen donor solvent. After slurrying, the mixture is passed to a hydroconversion zone 2. Within the hydroconversion zone 2, a hydrogen gas is added to the mixture through line 3 under hydroconversion conditions. It is not necessary, however, that the hydrogen gas be added at the hydroconversion zone 2. It can be added prior to the hydroconversion zone 2, if it is so desired.

Under typical hydroconversion conditions, the hydroconversion zone 2 is maintained at a temperature ranging from about 600°-1000° F., preferably from about 700°-900° F. The hydrogen partial pressure within the hydroconversion zone 2 will preferably range from about 500 psig to 5000 psig, more preferably from about 1000 psig to 3000 psig. Preferably, the hydroconversion zone 2 will have a residence time of about 0.1 minute to about 8 hours, more preferably about 2 to 120 minutes.

The hydroconversion product is removed from the hydroconversion zone 2, and sent to a separation zone 4 for separation into separate component product streams. The hydroconversion product stream comprises a combination of gas, liquid, and solid component streams at standard conditions. Gas and low boiling point liquids are preferably removed from the separation zone 4 as overhead streams. The separation zone 4 is preferably operated at standard flash conditions, Typically, the products of the hydroconversion zone 2 are flashed in the separation zone 4 at reduced pressure and at a temperature of about 400°-800° F.

The gas component stream removed from separation zone 4 comprises components having a boiling point of less than about 80° F. This stream includes compounds such as CO, $CO_2$, $H_2S$, and $C_1$-$C_4$ paraffins and olefins. The gas stream can be recovered as a separate product or a portion of the gas stream can be recycled to the hydroconversion zone 2, since the gas stream will typically contain a high concentration of a hydrogen gas which can be used as a hydrogen gas supply for the hydroconversion zone 2. The gas stream can also be scrubbed by conventional methods before or after the recycle location. Preferably, the gas stream is scrubbed before storing in an off-site facility. Scrubbing can be used to reduce the content of hydrogen sulfide or carbon dioxide.

The low boiling point liquid that is removed from the separation zone 4 can be recovered as a separate fuel product. It is preferred that this product be a distillate having a final boiling point of less than about 400° F., preferably a naphtha stream having a boiling point of about 80°-350° F.

As shown in FIG. 1, a middle to heavy boiling point fraction is removed from the separation zone 4 by a line 5 and sent to a residuum removal zone 6 by way of a line 5. The middle to heavy boiling point fraction comprises non-distillate solids materials which have passed through the separation zone 4 from the hydroconversion zone 2, as well as hydrocarbon liquids, preferably having an initial boiling point of at least about 350° F. In a catalytic hydroconversion process, besides unreacted carbonaceous material, a significant portion of the solids materials will include catalyst which also passes through the hydroconversion zone 2.

Within the residuum removal zone 6, ash residuum is separated from the liquid fraction, leaving a clarified fraction, preferably having an initial boiling point of at least about 350° F. The clarified liquid fraction is passed through a line 7 to a hydrocracking zone 8. Within the hydrocracking zone 8, the clarified fraction is contacted with catalyst and a hydrogen gas, under hydrocracking conditions, to form a hydrocracked product reaction stream. The catalyst is preferably an active metal catalyst prepared from an oil soluble metal compound or a dispersible metal compound having a metal content in the hydrocracking zone 8 of about 2-20 wt %, more preferably about 5-10 wt, on the basis of the clarified fraction.

The hydrocracking reaction is preferably carried out within the hydrocracking zone 8 under typical hydrocracking conditions. Preferably, the hydrocracking zone 8 will operate at a temperature of about 700°-900° F. and a residence time of about 5 minutes to 6 hours. The hydrogen gas can be molecular hydrogen or a hydrogen donating gas such as hydrogen sulfide, and is preferably added to the hydrocracking zone 8 through a line 9 at a hydrogen partial pressure of about 1000-3000 psig.

The hydrocracked reaction products are removed from the hydrocracking zone 8, and sent to a separation zone 10 for separation into separate component product streams. The hydrocracked reaction products comprise some gas as well as low and high boiling point liquid components as a result of the hydrocracking reaction. The gas and low boiling point liquids can be separated within the separation zone 10 as desired. The separation zone 10 can be operated under flash conditions or under vacuum depending upon the specific composition of the component streams that is desired. Preferably, the gas and low boiling point liquids which have a boiling point of less than about 350° F. are removed together as a light ends distillate fraction. The liquid portion of the light ends fraction typically includes naphtha.

If desired, a middle distillate stream can also be recovered from the separation zone 10. This middle distillate is preferably a distillate stream having a boiling point of about 350°-650° F. Such a boiling point liquid is typically a diesel fuel or fuel oil composition.

It is highly desirable to recover a wide cut middle and high boiling point distillate fraction from the separation zone 10 to use as the hydrogen donor solvent in the hydroconversion reaction. Preferably, the wide cut distillate solvent has an initial boiling point of about 350° F. and a final boiling point of about 900° F. As shown in FIG. 1, the wide cut distillate solvent can be used as the hydrogen donor solvent in the hydroconversion reaction by recycling the distillate through a recycle line 12 into the mixing zone 1.

Preferably, a portion of the hydrocracked product reaction stream which is separated in the separation zone 10 is recycled back to the hydrocracking zone 8. As shown in FIG. 1, the recycle can be by way of line 11 to line 7, or if preferred, line 11 can be used for direct recycle into the hydrocracking zone 8. Preferably, the recycle stream is a high boiling point distillate stream having a boiling point of at least about 650° F., more preferably at least about 900° F. The purpose of the recycle stream is to return unconverted carbonaceous material for further hydrocracking, and to return any catalyst which leaves the hydrocracking zone 8 along with the hydrocracked product.

Having now generally described this invention, the same will be better understood by reference to certain specific examples which are included herein for purposes of illustration only and are not intended to be limiting of the invention, unless otherwise specified.

EXAMPLE 1

Particulate Illinois-Monterrey coal, 40 gm, and 1000 PPM of Mo catalyst prepared from an oil soluble catalyst precursor, dioxoModithiocarbamate, is slurried in 64 gm of a hydrogenated wide cut coal distillate fraction having a boiling point of about 400°-1000° F. The slurry is heated to 860° F. in a reaction vessel and hydroconverted by contacting with molecular hydrogen at a hydrogen partial pressure of 2500 psig for 2 minutes. Hydrogen was consumed at 2 gm of hydrogen per 100 gm of DAF (dry ash free) coal. The product composition resulting from the reaction is shown in Table 1. The $C_1$-$C_4$ range represents a hydrocarbon having a boiling point of less than about 80° F., and the $C_5$-1000° F. range represents hydrocarbons boiling point range of about 80°-1000° F.

TABLE 1

| Composition | wt % DAF coal or PPM |
|---|---|
| Chemgas | 2.1 |
| $C_1$-$C_4$ | 5.2 |
| $C_5$-1000° F. | 28.3 |
| 1000° F.+ | 66.4 |
| Conversion to liq. fraction | 89.4 |
| N, PPM in liq. fraction | 6166 |
| S, PPM in liq, fraction | 1850 |
| H/C ratio of liq. fraction | 1.37 |

EXAMPLE 2

The product from the reaction of Example 1 is filtered using a Buchner funnel with a Whatman #2 filter paper at about 250° F., to obtain a clarified liquid fraction. The clarified fraction is distilled to remove hydrocarbons having a boiling point of less than 400° F., and the 100 gm of the distilled fraction is hydrocracked using a 5 wt % Ni—Mo catalyst prepared from an oil soluble catalyst precursor, NiEEX and dioxoModithiocarbamate. The distilled fraction and the catalyst are heated to 800° F. in a reaction vessel and hydrocracked by contacting with molecular hydrogen at a hydrogen partial pressure of 2000 psig for 240 minutes. Hydrogen was consumed at 3.1 gm of hydrogen per 100 gm of clarified fraction. The product composition resulting from the reaction is shown in Table 2. The $C_1$–$C_4$ range represents hydrocarbons having a boiling point of less than about 80° F., and the $C_5$–400° F. range represents a hydrocarbon boiling point range of about 80°–400° F.

TABLE 2

| Composition | wt % or PPM |
|---|---|
| $C_1$–$C_4$ | 5.4 |
| $C_5$–400° F. | 19.5 |
| 400–650° F. | 56.2 |
| 650–1000° F. | 22.7 |
| 1000° F+ | 0.1 |
| N, PPM in liq. fraction | 18 |
| S, PPM in liq, fraction | 100 |
| H/C ratio of liq. fraction | 1.63 |

EXAMPLE 6

The hydroconversion experiment of Example 1 and the hydrocracking experiment of Example 2 are combined and the products of the combined hydroconversion and hydrocracking reaction are calculated on the basis of the DAF coal input to the hydroconversion reaction. Hydrogen is consumed in the overall experiment at 6.4 gm of hydrogen per 100 gm of DAF coal. The results are shown in Table 3. The $C_1$–$C_4$ range represents a hydrocarbon having a boiling point of less than about 80° F., and the $C_5$–1000° F. range represents hydrocarbons boiling point range of about 80°–1000° F.

TABLE 3

| Composition | wt % or PPM |
|---|---|
| Chemgas | 7.7 |
| $C_1$–$C_4$ | 9.5 |
| $C_5$–1000° F. | 65.2 |
| 1000° F+ | 10.7 |
| Conversion to liq. fraction (1500° F.−) | 89.3 |
| N, PPM in liq. fraction | 18 |
| S, PPM in liq. fraction | 100 |
| H/C ratio of liq. fraction | 1.63 |

Having now fully described this invention, it will be appreciated by those skilled in the art that the same can be performed within a wide range of equivalent parameters of compositions and conditions without departing from the spirit or scope of the invention or any embodiment thereof.

What is claimed is:

1. A process for hydroconverting a carbonaceous material comprising forming a mixture of carbonaceous material and hydrogen donor solvent;

reacting the mixture in the presence of a hydrogen containing gas, under hydroconversion conditions, to form a hydroconversion product stream;

separating a liquid fraction of the hydroconversion product stream, wherein the liquid fraction has an initial boiling point of about 350° F., into a clarified fraction and ash residuum; and hydrocracking the clarified fraction in the presence of hydrogen and a catalyst consisting of an activated metal prepared from an oil soluble or oil dispersible metal compound, under hydrocracking conditions, wherein the metal has a concentration of about 2–20 wt % on the basis of the clarified fraction being hydrocracked, and is selected from the group consisting of Groups II, III, IV, V, VIB, VIIB and VIII of the Periodic Table of Elements, to form a hydrocarbon product stream.

2. The process of claim 1, wherein a distillate fraction having an initial boiling point of about 350° F. is separated from the hydrocracked product stream and recycled as the hydrogen donor solvent.

3. The process of claim 1, wherein the metal is selected from the group consisting of Mo, Ni, Co, Cu, Pt, Pd and Sn.

4. The process of claim 1, wherein the metal is Mo promoted with Ni, Co, Cu, Pt, Pd or Sn.

5. The process of claim 1, wherein the metal is Mo and Ni at a molar ratio of between 2:1 and 4:1.

6. The process of claim 1, wherein the metal catalyst is activated from the oil soluble metal by dissolving the oil soluble metal in a hydrogen donor solvent and heating at a temperature ranging from about 600° F. to 1000° F., at a pressure ranging from about 500 psig to 5000 psig, in the presence of a hydrogen containing gas.

7. The process of claim 6, wherein the oil soluble metal and the hydrogen donor solvent are dissolved at a solvent to oil soluble metal compound ratio of about 1–2 to 1.

8. The process of claim 6, wherein the hydrogen containing gas is molecular hydrogen or a hydrogen donating gas.

9. The process of claim 1, wherein the ash residuum is separated by centrifugation, filtration, hydroclone separation, liquid extraction or distillation.

* * * * *